US006417804B1

(12) United States Patent
Merlet et al.

(10) Patent No.: US 6,417,804 B1
(45) Date of Patent: Jul. 9, 2002

(54) CONTROL DEVICE FOR THE FORMATION OF SEVERAL SIMULTANEOUS RADAR RECEPTION BEAMS FOR AN ELECTRONIC SCANNING ANTENNA

(75) Inventors: Thomas Merlet, Dourdan; Olivier Maas, Gif S/Yvette, both of (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/696,166

(22) Filed: Oct. 26, 2000

(30) Foreign Application Priority Data

Oct. 26, 1999 (FR) ..... 99 13358

(51) Int. Cl.[7] ..... H01Q 3/22
(52) U.S. Cl. ..... 342/368; 342/154; 342/372
(58) Field of Search ..... 342/368, 372, 342/375, 154, 157, 371

(56) References Cited

U.S. PATENT DOCUMENTS

| | | | | |
|---|---|---|---|---|
| 4,686,533 A | * | 8/1987 | MacDonald et al. | 342/373 |
| 4,725,844 A | * | 2/1988 | Goodwin et al. | 342/374 |
| 5,131,748 A | * | 7/1992 | Monchalin et al. | 356/349 |
| 5,861,845 A | | 1/1999 | Lee et al. | |
| 5,909,297 A | * | 6/1999 | Ishikawa et al. | 359/161 |
| 5,917,970 A | * | 6/1999 | Burns et al. | 385/24 |

FOREIGN PATENT DOCUMENTS

| | | |
|---|---|---|
| EP | 0 708 491 | 4/1996 |
| EP | 0 793 291 | 9/1997 |

OTHER PUBLICATIONS

Leo G. Cardone, "Wideband Electro–optical Microwave Beamforming Technique" Conference Proceedings of Military Microwaves, Jun. 24–26, 1986, pgs. 391a–391f.

Luc Pastur, et al. "Two–dimensional Optical Architectures For The Receive Mode of Phased–array Antennas", Applied Optics, U.S. Optical Society of America, Washington, vol. 38, No. 14, May 10, 1999, pgs. 3105–3111.

* cited by examiner

*Primary Examiner*—Dao Phan
(74) *Attorney, Agent, or Firm*—Oblon, Spivak, McClelland, Maier & Neustadt, P.C.

(57) ABSTRACT

A control device for the formation of plural simultaneous radar reception beams in an electronic scanning antenna. The electronic scanning antenna includes an array of detectors of a reception microwave signal arranged in n columns and m rows. The control device makes, in the microwave domain, a first partial combination of the signals received, the first combination being made according to each column. An optical device makes a second partial combination in the optical domain, the optical device including at least n optical sources each producing an optical signal modulated at the frequency of the reception microwave signal by an associated microwave combination signal. The optical signal is divided into r optical signals to obtain nxr optical signals. An optical phase-shifting device is provided for each of the nxr optical signals obtained, and r combining devices combine each group of n optical signals, and r detectors detect the microwave signal f assigned to each group of n optical signals to form r microwave reception beams. The control device can be applied especially to a simple and flexible reconfiguration of reception beams of an electronic scanning antenna.

20 Claims, 1 Drawing Sheet

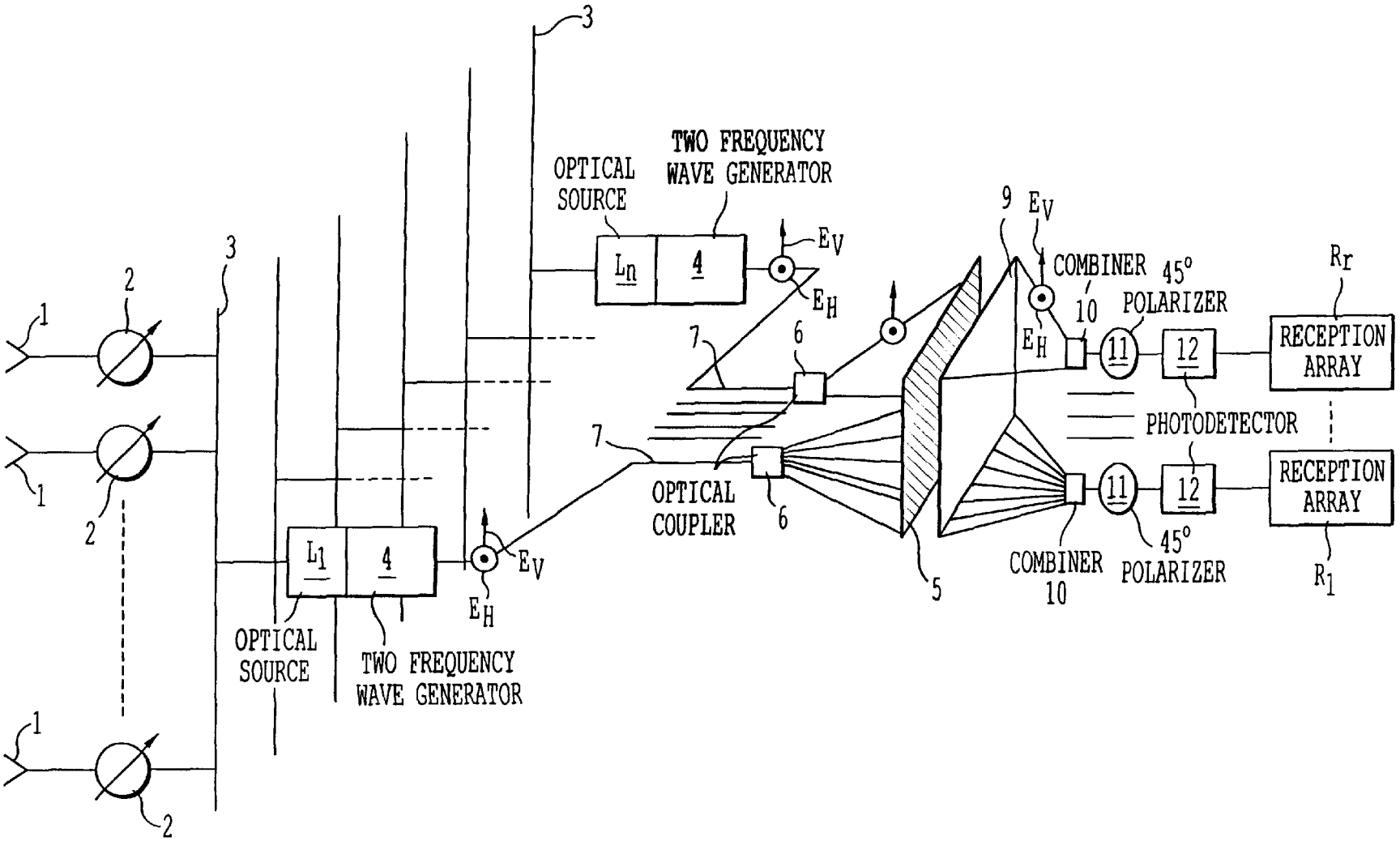
RECEPTION ARRAY
Rr
RECEPTION ARRAY
R1
PHOTODETECTOR
12
12
45° POLARIZER
45° POLARIZER
11
11
COMBINER 10
COMBINER 10
EV
EH
9
5
6
6
7
7
TWO FREQUENCY WAVE GENERATOR
4
OPTICAL SOURCE
Ln
OPTICAL COUPLER
3
3
TWO FREQUENCY WAVE GENERATOR
4
OPTICAL SOURCE
L1
2
2
2
1
1
1

CONTROL DEVICE FOR THE FORMATION OF SEVERAL SIMULTANEOUS RADAR RECEPTION BEAMS FOR AN ELECTRONIC SCANNING ANTENNA

BACKGROUND OF THE INVENTION

1. Field of the Invention

The present invention relates to a control device for the formation of several simultaneous radar reception beams in an electronic scanning antenna. It can be applied especially to the control of the radiation pattern of an electronic scanning antenna with a view to reconfiguring the reception beams with high flexibility, whatever the passband of the radar.

2. Description of the Prior Art

An electronic scanning antenna comprises a plurality of radiating elements carrying out both the transmission and the reception of a microwave signal. A transmission or reception beam is constituted by all the signals sent or received by each element. To orient a beam in a given direction θ, time delays have to be created between signals sent or received by the different radiating elements. To obtain a similar effect, there are known ways of creating a phase delay between these signals. The phase shift $\phi_1-\phi_2$ between the signals sent or received by the two radiating elements is therefore given by the following relationship:

$$\Phi_1 - \Phi_2 = \frac{d\sin\theta}{c} \times 2\pi f \tag{1}$$

where d, f and c respectively represent the distance between the two radiating elements, f the frequency of the signals and c the speed of light, the time delay created being $$T_1 - T_2 = \frac{d\sin\theta}{c}.$$

For its part, the phase shift $\phi_1-\phi_2$ is equal to $2\pi f(T_1-T_2)$.

Instead of the approach described here above, which makes use of microwave control circuits, it may be preferred to adopt an approach using optical control circuits, especially for passband problems. The above relationship (1) indeed shows a drawback, in that the phase shift depends on the frequency. As a consequence, if the frequency varies, the pointing angle varies too. This method of orientation of a beam is therefore not suited for a wideband radar. However, it is not possible, with microwave techniques, to create a temporal delay between the signals except by creating the above phase shift, unless it is chosen to implement a device that is prohibitively costly and bulky.

The use of optical techniques does away with the above-mentioned drawback, by controlling the radiating elements directly through time delays, without using the contrived solution of phase shifts, these delays being created in the optical domain. To this end, solutions for the optical control of electronic scanning antennas have already been implemented. For transmission, many optical control architectures have therefore already been proposed in order to check the radiation pattern at transmission.

With regard to the reception of the signals by the antenna, beam formation calls for a very great dynamic range which is as yet beyond the reach of optical components. The dynamic range, in terms of radar, is characterized by the signal-to-noise ratio where the term "noise" includes the intermodulation phenomena caused by the non-linearities of the chain generally known in the literature as the SFDR or "Spurious Free Dynamic Range".

The speed with which the beam is switched over in a given direction by means of a command is another difficulty, which is a second-order difficulty with respect to the dynamic range.

In order to overcome this problem of dynamic range, an optical control architecture, based on correlation, was presented in the French patent application No. 94 11498 and then complemented by an architecture presented in the French patent application No. 98 07240. This optical architecture with correlation can be used, in both reception and transmission, as a system of control based on temporal delays along the two planes in elevation and in relative bearing. However, this architecture can be used for the formation of only one beam. It does not provide for a multiple-beam reception, namely reception with many simultaneous beams. Now, for many radar applications, it is necessary, at least in one of the planes of the radar, elevation or relative bearing, to form several beams at reception, for example sets of sum and difference beams.

If the passband is not essential for certain radar applications that may accept medium bandwidths, then multiple-beam reception is possible in control techniques based on microwave circuits alone. At reception, the radar echo is detected on a array antenna by a matrix of n rows by m columns of microwave detectors constituting the antenna block. These elementary signals are individually weighted in amplitude and in phase and then summed to form a reception beam. This beam is characterized by its angular direction with respect to the normal to the antenna and by its radiation pattern. In order to simultaneously form several reception beams, it is necessary to divide the elementary signals to direct them towards different weighting matrices and different summators. These weighting operations are performed in microwave technology, and are unchangeable. The reconfiguring of the reception beams is nevertheless possible through the use of architectures for beam-formation by computation known as FFC architectures. These architectures are nevertheless expressed by an increased complexity in terms of radar treatment. These are indeed real-time processing operations that dictate the use of many complex and costly processors. In other words, the complexity of the processing limits the number of receivers in the FFC architectures.

Thus, it is not possible to carry out a simple implementation of a multiple-beam radar with a wide dynamic range, whether by the use of a microwave command, which does not permit a dynamic allocation of the beams formed, or in the digital domain which dictates a limitation on the number of channels (sub-arrays) sampled.

SUMMARY OF THE INVENTION

An aim of the invention especially is to provide for a simple embodiment of a multiple-beam reception with a wide dynamic range.

SUMMARY OF A INVENTION

To this end, an object of the invention is a control device for the formation of radar reception beams of an electronic scanning antenna comprising a array of detectors of microwave signals positioned in n sub-arrays of detectors, the control device comprising:

means for making, in the microwave domain, a first partial combination of the signals received, this combination being obtained according to each sub-array;

optical means to make a second partial combination in the optical domain, the optical means comprising at least n optical sources each producing an optical signal modulated at the frequency of the reception microwave signals f by an associated microwave combination signal, means for the division of this optical signal into r optical signals, means for the optical phase-shifting of each of the nxr optical signals obtained, r means of combining each group of n optical signals and r means of detection of the modulation signal f assigned to each group of n optical signals to form r microwave reception beams.

The main advantages of the invention, moreover, are that it reduces the complexity of the digital processing in relation to the formation of FFC radar beams, procures immunity against electromagnetic disturbances, provides a gain in lightness and compactness, and can be applied to all radar frequency bands.

BRIEF DESCRIPTION OF THE DRAWINGS

Other features and characteristics of the invention shall appear from the following description, made with reference to the single FIGURE which is a diagrammatic view of a possible embodiment of a control device according to the invention.

MORE DETAILED DESCRIPTION

The appended FIGURE therefore shows an exemplary embodiment of a control device according to the invention, This device controls the formation of several reception beams $R_1, \ldots R_r$ of an electronic scanning radar antenna. It carries out a partial microwave summation of the signals received by the elementary antenna detectors, followed by an incoherent summation in optics technology.

An electronic scanning reception antenna comprises n microwave signal detector sub-arrays 1. To facilitate the description of the invention, it is assumed that the sub-arrays are columns. However, the subarrays could be arranged in any orientation. Each column comprises. for example, m detectors 1. Each detector is followed by a phase-shifter 2. For ease of representation, only the detectors and the phase-shifters of the first column are shown. The phase-shifters 2 are controlled by standard means as a function of the desired direction along the component parallel to the column, for example the vertical direction if this component is vertical. For each column, the signals coming from the phase-shifters are summated by a microwave combiner 3. The control device according to the invention therefore comprises means to obtain a partial microwave summation of the signals received according to each column. These means comprise especially the phase-shifters 2 and their commands as well as the microwave combiners 3. This partial summation is obtained conventionally by known means. Each of the n columns therefore gives a signal summated according to one dimension of space, for example the vertical dimension.

The signals coming from the columns, at output of the combiners 3, each modulate an optical source $L_1, \ldots L_n$ at the reception frequency f of the received signals. The optical sources $L_1, \ldots L_n$ are for example lasers. Each optical source is followed, for example, by means 4 for the generation of a cross-polarized, two-frequency optical wave, one frequency being at $\omega/2\pi+f$ and one frequency at $\omega/2\pi$. The frequency f is that of the received signal. The frequency $\omega/2\pi$ is the frequency of the optical wave produced by the light wave $L_1, \ldots L_n$. A frequency $\omega/2\pi+f$ is transmitted according to a first polarisation, for example a vertical polarisation $E_V$. The other frequency $\omega/2\pi$ is transmitted on a perpendicular polarization, for example the horizontal polarization $E_H$, the two polarizations being perpendicular to the direction of transmission of the optical wave. The optical signal, which has a frequency $\omega/2\pi$, is therefore transmitted according to one polarization while the optical signal modulated by the frequency f of the microwave reception signal, with a frequency $\omega/2\pi+f$, is transmitted according to the perpendicular polarization. The modulated optical signal may be obtained by a frequency translator which is, for example, an acousto-optical Bragg cell.

The n crossed-polarized two-frequency optical signals are sent to optical phase-shifting means 5. Before entering these optical phase-shifting means, each signal enters a 1/r optical coupler 6 that divides this signal into r optical signals, r being the number of reception beams of the radar to be formed. The n optical channels 7 coming from the two-frequency wave generation means 4 are therefore each divided into r optical channels 8 by means of these 1/r optical couplers, an optical channel being a path along which an optical signal is propagated. The exemplary embodiment presented by the figure illustrates a mode of transmission of the optical signals in free space. A device according to the invention may however comprise optical channels 7, 8 that are optical guides or optical fibers.

At output of the couplers 6, the nxr optical channels are directed towards the optical phase-shifting means 5. These means are, for example, a liquid-crystal matrix comprising nxr pixels. This phase matrix imprints an optical phase controlled by an electrical voltage, on each pixel, at one of the polarizations, according to an anisotropic mode. The frequency $\omega/2\pi+f$ becomes, for example $\omega/2\pi+f+\phi_{i,j}$, for the optical signal that encounters the pixel i, j of the row i and of the column j on the phase matrix 5. The device according to the invention has means, not shown, for the application of voltage to the pixels. These means apply a voltage $V_{i,j}$, to each pixel i, j.

The optical phase-shifting means 5 are, for example, followed by amplitude-weighting means 9. These means act on the two polarizations $E_V$, $E_H$ in modifying the amplitude of the two optical waves of each of the channels 8. These amplitude-weighting means are, for example, a liquid crystal matrix comprising nxr pixels. The amplitude weighting, like the phase-shifting, is driven pixel by pixel by voltage-control means, not shown. An amplitude weighting is applied to each of the nxr optical signals 8.

To form r microwave reception arrays $R_1, \ldots R_r$, the device according to the invention comprises r means for the detection of the microwave signal assigned to each group of n optical signals. This signal is in fact the modulation signal at the reception frequency f having undergone the phase-shifts $\phi_{i,j}$. Thus, the n optical channels 7, divided according to the columns (for example vertically) into r channels before the matrices, are grouped, after these matrices, into rows (for example horizontally) to form r optical beams with n components that are phase-shifted and possibly amplitude-weighted. The grouping of the channels is done by means of 1/n optical combiners 10. The n channels of each row are combined by a combiner 10.

Each combiner 10 is followed by a 45° polarizer 11 whose function is to recombine the two polarizations in one and the same direction. The two coherent waves then interfere at output of each polarizer 11. This polarizer 11 is followed by a photodetector 12. A photodetector 12 thus detects a signal proportional to the phases and amplitudes imprinted on the elementary optical channels 8 by the optical phase-shifting means 5 and the amplitude-weighting means 9. The two waves therefore interfere at the input of this photodetector. The spectral lines at $\omega/2\pi+f$ and at $\omega/2\pi$ are therefore subjected to beating and the difference between the two lines then gives the reception frequency f.

The device according to the invention can then be used to obtain, at output of the r photodetectors 12, r radar beams $R_1, \ldots R_r$ formed fixedly in a dimension where the combinations are made by microwave technology and can be reconfigured in the other dimension where the combinations are made by optics technology. The latter configuration of the beams is achieved in the optical phase-shifting means 5. The phase laws to be applied are, for example, programmed in means to control the voltages of pixels of a liquid crystal matrix 5. In addition to phase laws, amplitude-weighting laws may, for example, be applied to the elementary channels 8 by the amplitude-weighting means 9. The power $P_j$ in each of the r output beams is then given by the following relationship:

$$P_j = \sum_{i=1}^{n} P_{ij}\cos\varphi_{ij}$$

The phases $\phi_{ij}$ are imprinted by the optical phase-shifting means 5, and the power values $P_{ij}$ are for example weighted by the weighting means 9.

A voltage controllable liquid crystal matrix screen with nxr pixels has been presented as an exemplary embodiment of the optical phase-shifting means, This embodiment especially has the advantage of being simple to implement. These means may of course be made differently.

These phase-shifting means may also be replaced by means for the creation of temporal delays on the n×r elementary signals 8. These means may, for example, be a switchable optical path device as described in the French patent No. 90 03386. The temporal delays then enable the processing of the signals in a very wide instantaneous band.

The invention can be applied with an optics technology in free propagation using liquid crystal matrices 5, 9 to carry out weighting operations in phase and in amplitude. These weighting operations may also be obtained in guided optics by the fabrication, on semiconductors, for example InP, of the optical guides, couplers and phase and amplitude modulators. In this case, the presence of the polarizes 11 is no longer necessary.

A device according to the invention has the advantage. especially, of enabling a reconfiguration of the radar reception beams by simply bringing into play the control voltages of the phase 5 and amplitude 9 optical matrices, or any other means of optical phase-shifting, creation of time delays or amplitude-weighting operations. This possibility is not open to the microwave combiners. Consequently, the invention proposes especially an advantageous alterative to the radar architectures with beam formation by computation. Compared to a digital approach, a formation of beams by optics technology minimizes the number of receivers and considerably simplifies the complexity of the processing. Furthermore, the partial combination in microwave technology as well as the optical summation of different beams, in particular reduces the constraints of dynamic range that are a burden on optical architectures for reception, since a part of the orientation of the reception beams is processed by the microwave techniques.

As other advantages, the invention also brings immunity against electromagnetic disturbances, a gain in weight and a gain in compactness through the optical technologies. Finally, the invention can be applied to all the radar frequency bands.

The invention has been described in the case where the microwave reception signals are summated by columns, vertically. It is of course possible to summate the microwave reception signals by rows, horizontally or by any arrays of a given geometrical form. However, a microwave summation along vertical columns, for example, diminishes the effects of clutter, whether ground or sea clutter. Indeed, each radiating element 1 sends or receives signals in a very wide aperture, but in summating along a column or a row, a precise direction is favored along this column or this row. Along a vertical direction, the ground or sea clutter is added incoherently to one column or other and the signal-to-noise ratio then increases. It would not be the same in a horizontal direction where the ground or sea clutter would get added more coherently.

What is claimed is:

1. A control device for the formation of plural simultaneous radar reception beams of an electronic scanning antenna comprising an array of detectors of a reception microwave signal arranged in n sub-arrays of detectors, n is an integer, comprising:

means for making, in the microwave domain, a first partial combination of the reception microwave signals, the first partial combination being made according to each sub-array;

optical means for making a second partial combination in the optical domain, the optical means comprising at least n optical sources each associated with a respective sub-array and each producing a respective optical signal modulated by the signal coming from its respective sub-array, at a frequency of the reception microwave signal, means for dividing the optical signal into r optical signals to generate nxr optical signals from the n optical sources, r is an integer, means for optical phase-shifting each of the nxr optical signals obtained, r means for combining each group of n optical signals, and r means for detecting the microwave signal assigned to each group of n optical signals to form r microwave reception beams.

2. A device according to claim 1, wherein the optical means further comprises, at an output of each optical source, means for generating a cross-polarized two-frequency optical wave, a first frequency being at $\omega/2\pi+f$ and a second frequency at $\omega/2\pi$, wherein frequency f is a frequency of the reception microwave signal, the second frequency $\omega/2\pi$ being a frequency of the optical wave produced by the light source, the first frequency $\omega/2\pi+f$ being transmitted in a first polarization, the second frequency $\omega/2\pi$ being transmitted in a perpendicular polarization to the first polarization.

3. A device according to claim 1, wherein the optical phase-shifting means comprises a liquid crystal matrix comprising nxr pixels, which apply a phase shift pixel by pixel to the nxr optical signals coming from the dividing means, a phase-shift being controlled by an electric voltage.

4. A device according to claim 3, wherein the phase-shift is applied to a polarization conveying the signal at the first frequency $\omega/2\pi+f$.

5. A device according to claim 2, wherein the means for detecting a microwave signal comprises a 45° polarizer recombining the two polarizations in a same direction and a photodetector detecting the microwave signal.

6. A device according to claim 1, wherein the optical means further comprises amplitude-weighting means associated with the optical phase-shift means, amplitude-weighting means being applied to each of the nxr optical signals.

7. A device according to claim 1, wherein the optical signal is modulated by a Bragg cell.

8. A device according to claim 1, wherein the microwave combining means comprises microwave phase-shifters and means for controlling the microwave phase-shifters to configure the reception beams along a direction defined by the sub-arrays.

9. A device according to claim 1, wherein the sub-arrays are columns, the detectors of the columns being arranged vertically.

10. A device according to claim 1, wherein the sub-arrays are rows, the detectors of the rows being positioned horizontally.

11. A control device for the formation of plural simultaneous radar reception beams of an electronic scanning antenna comprising an array of detectors of a reception microwave signal arranged in n sub-arrays of detectors, n is an integer, comprising:

a microwave summator configured to summate, in the microwave domain, a first partial combination of the reception microwave signals, the first partial combination being made according to each sub-array;

an optical device configured to make a second partial combination in the optical domain, the optical device comprising at least n optical sources each associated with a respective sub-array and each producing a respective optical signal modulated by the signal coming from its respective sub-array, at a frequency of the reception microwave signal, an optical divider for dividing the optical signal into r optical signals to generate nxr optical signals from the n optical sources, r is an integer, an optical phase shifter configured to phase-shift each of the nxr optical signals obtained, r combining devices configured to combine each group of n optical signals, and r detectors configured to detect the microwave signal assigned to each group of n optical signals to form r microwave reception beams.

12. A device according to claim 11, wherein the optical device further comprises, at an output of each optical source, a two frequency wave generator for generating a cross-polarized two-frequency optical wave, a first frequency being at $\omega/2\pi+f$ and a second frequency at $\omega/2\pi$, wherein frequency f is a frequency of the reception microwave signal, the second frequency $\omega/2\pi$ being a frequency of the optical wave produced by the light source, the first frequency $\omega/2\pi+f$ being transmitted in a first polarization, the second frequency $\omega/2\pi$ being transmitted in a perpendicular polarization to the first polarization.

13. A device according to claim 11, wherein the optical phase-shifter comprises a liquid crystal matrix comprising nxr pixels, which apply a phase shift pixel by pixel to the nxr optical signals coming from the optical divider, a phase-shift being controlled by an electric voltage.

14. A device according to claim 13, wherein the phase-shift is applied to a polarization conveying the signal at the first frequency $\omega/2\pi+f$.

15. A device according to claim 12, wherein the detectors for detecting a microwave signal comprises a 45° polarizer recombining the two polarizations in a same direction and a photodetector detecting the microwave signal.

16. A device according to claim 11, wherein the optical device further comprises a liquid crystal matrix for associated with the optical phase-shifter, configured to amplitude-weight each of the nxr optical signals.

17. A device according to claim 11, wherein the optical signal is modulated by a Bragg cell.

18. A device according to claim 11, wherein the combining devices comprise microwave phase-shifters to configure the reception beams along a direction defined by the sub-arrays.

19. A device according to claim 11, wherein the sub-arrays are columns, the detectors of the columns being arranged vertically.

20. A device according to claim 11, wherein the sub-arrays are rows, the detectors of the rows being positioned horizontally.

* * * * *